US007244914B2

(12) United States Patent
Yoneyama et al.

(10) Patent No.: US 7,244,914 B2
(45) Date of Patent: Jul. 17, 2007

(54) SHEET HEATER

(75) Inventors: Mitsuru Yoneyama, Nara (JP); Naohito Asami, Nara (JP); Akira Shiratake, Nara (JP); Norio Abe, Kanagawa (JP); Kazumi Nagayama, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/408,668

(22) Filed: Apr. 8, 2003

(65) Prior Publication Data

US 2003/0213797 A1 Nov. 20, 2003

(30) Foreign Application Priority Data

Apr. 8, 2002 (JP) ..... 2002-104842

(51) Int. Cl.
*H05B 3/34* (2006.01)

(52) U.S. Cl. ..... 219/545; 219/542; 219/528; 219/211; 219/217; 219/202; 219/552; 219/529; 219/538; 219/548; 219/549; 297/180.12

(58) Field of Classification Search ..... 219/202, 219/211, 217, 527, 528, 529, 538, 545, 548, 219/552; 87/10; 297/180.12
See application file for complete search history.

(56) References Cited

U.S. PATENT DOCUMENTS

| | | | | |
|---|---|---|---|---|
| 3,729,613 | A * | 4/1973 | Deloire et al. | 219/211 |
| 4,044,221 | A * | 8/1977 | Kuhn | 219/217 |
| 4,413,857 | A * | 11/1983 | Hayashi | 297/180.11 |
| 4,629,868 | A * | 12/1986 | Svensson | 219/528 |
| 4,869,550 | A * | 9/1989 | Lorenzen et al. | 297/180.12 |
| 5,023,433 | A * | 6/1991 | Gordon | 219/548 |
| 5,105,067 | A * | 4/1992 | Brekkestran et al. | 219/497 |
| 5,883,363 | A * | 3/1999 | Motoyoshi et al. | 219/529 |
| 6,068,332 | A * | 5/2000 | Faust et al. | 297/180.13 |
| 6,073,998 | A * | 6/2000 | Siarkowski et al. | 297/180.12 |
| 6,540,303 | B2 * | 4/2003 | Mosquera | 297/452.583 |
| 2002/0056709 | A1 * | 5/2002 | Burt | 219/217 |

FOREIGN PATENT DOCUMENTS

| | | | |
|---|---|---|---|
| DE | 3040888 | * | 5/1982 |
| DE | 003425798 | * | 10/1985 |
| JP | 401301422 | * | 12/1989 |
| JP | 03-145089 | | 6/1991 |
| JP | 404352911 | * | 12/1992 |
| JP | 5-184440 | | 7/1993 |
| JP | 5-266971 | | 10/1993 |
| JP | 8-507404 | | 8/1996 |
| JP | 11-154588 | | 6/1999 |
| JP | 02000333781 | * | 12/2000 |
| JP | 1132028 | * | 12/2001 |
| WO | WO 94/09684 | * | 5/1994 |

OTHER PUBLICATIONS

Japanese Office Action Issued in Japanese Patent Application No. JP2002-104842, dated Apr. 3, 2007.

* cited by examiner

*Primary Examiner*—Philip H. Leung
*Assistant Examiner*—Stephen J. Ralis
(74) *Attorney, Agent, or Firm*—McDermott Will & Emery LLP

(57) ABSTRACT

A sheet heater structured so that heating wire is fixed to air-passing base material by sewing. This structure can provide a sheet heater that has improved durability of heating wire 2 against the load imposed on the seat during sitting, comfortable feeling of sitting in the seat, and high air-passing capability.

6 Claims, 5 Drawing Sheets

SHEET HEATER

BACKGROUND OF THE INVENTION

1. Field of the Invention

The present invention relates to a sheet heater for use in a seat and the like, and more particularly to a sheet heater incorporated in a seat for a vehicle.

2. Background art

A sheet heater incorporated in the seat is used for warming up a seat for a vehicle. FIG. 8 is a perspective view for illustrating an example of a conventional sheet heater incorporated in a seat for a vehicle. With reference to FIG. 8, sheet heater 101 is incorporated between external surface 103 and main pad 104 of seat 102.

In recent years, it has been requested to add means of cooling a seat itself as one of means of further improving passenger comfort in the environment of the vehicle interior. Seat cooling system using Peltier devices in combination has been put to practical use. However, with this technique, because warm air is blown out of the surface of the seat at heating, the temperature feeling is lower than the actual temperature of the warm air and a sufficient heating effect cannot be obtained. As a countermeasure against this phenomenon, a combination of a conventional sheet heater and cooling using Peltier devices or air blasting using a fan is considered. As a factor necessary for this countermeasure, improvements in air-passing capability of the sheet heater are requested.

An example of an air-passing sheet heater is described in the Japanese Patent Unexamined Publication No. H08-507404. FIG. 9 is a sectional view of a conventional sheet heater described in this publication.

With reference to FIG. 9, a heating element (hereinafter referred to as a "sheet heater") is made up of electrically-insulating and air-passing carrier layer (hereinafter referred to as "base material") 105, heating loop (hereinafter referred to as "heating wire") 106 formed on carrier layer 105, and friction layer (hereinafter referred to as "protective material") 107 for protecting the heating wire. Examples of the air-passing base material include a base material having a mesh structure. Conventionally, adhesive has been used to fix heating wire 106 to base material 105 and fix protective material 107 to base material 105 and heating wire 106.

However, the conventional structure has a problem: thermal stress caused by repeated electrical conduction deteriorates the adhesive that fixes heating wire 106, and heating wire 106 is peeled from base material 105 by the load imposed on the seat during sitting.

There is another problem: because heating wire 106 is fixed to base material 105 using adhesive, fixed heating wire 106 has an extremely low degree of freedom and thus heating wire 106 is likely to be broken by the load imposed thereon. In other words, because heating wire 106 is fixed to base material 105, when wrinkles are generated by the load, such as weight imposed on the seat by sitting, heating wire 106 follows the wrinkles in base material 105 and bends. As a result, the load is concentrated on heating wire 106 in these wrinkles, and repeated bending leads heating wire 106 to breakage. Especially when through-holes are provided in base material 105 to impart air-passing capability, decrease in the strength of base material 105 is likely to generate wrinkles in base material 105. As a result, heating wire 106 fixed to a base material having through-holes is more likely to be broken than the case without the through-holes.

Further, because heating wire 106 is fixed to base material 105 using adhesive, base material 105 is impregnated with the adhesive and base material 105 itself is hardened. This poses another problem of reducing user's comfort of sitting in the seat.

Additionally, when base material 105 having a mesh structure is used to improve air-passing capability, the area in which heating wire 106 is in contact with base material 105 is smaller. Therefore, in order to sufficiently hold heating wire 106 against the weight applied to the seat during sitting, it is necessary to fasten heating wire 106 between base material 105 and protective material 107. This arrangement can improve the adhesive strength toward heating wire 106 and reduce the weight directly applied to heating wire 106. However, this arrangement poses a problem of increasing the number of members and operations in production.

SUMARRY OF THE INVENTION

The present invention aims to provide a sheet heater that ensures air-passing capability and fixation of a heating wire to a base material thereof.

In order to address the conventional problems, the sheet heater of the present invention is structured so that a heating wire is fixed to an air-passing base material by sewing.

DETAILED DESCRIPTION OF THE INVENTION

Exemplary embodiments of the present invention are detailed hereinafter with reference to the accompanying drawings.

First Embodiment

Figure 1:
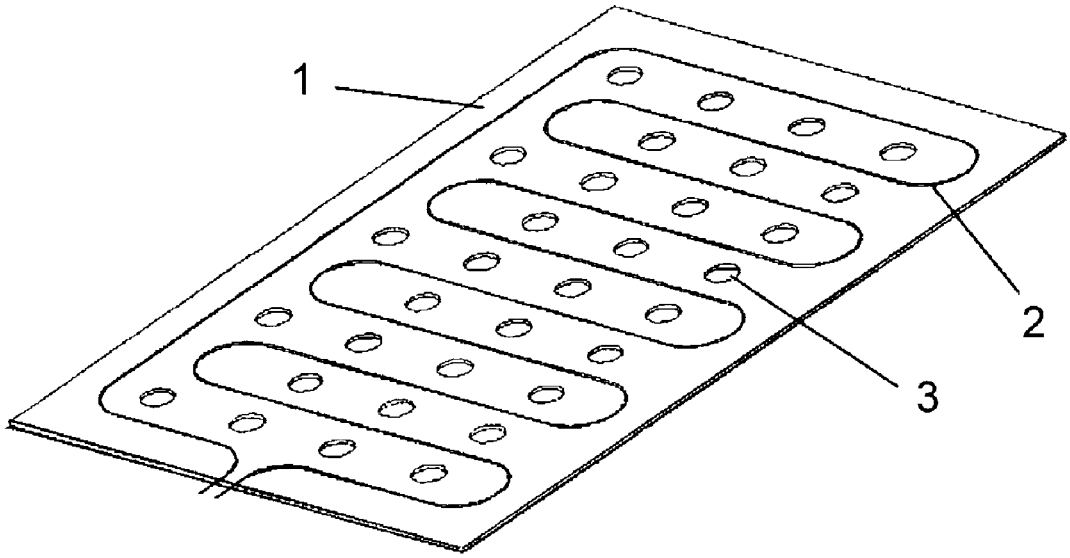
FIG. 1 is a perspective view of a sheet heater in accordance with a first exemplary embodiment of the present invention.

FIG. 1 is a schematic diagram of a sheet heater of the first exemplary embodiment. A heating wire is fixed to an air-passing base material by sewing. With reference to FIG. 1, air-passing base material 1 has through-holes 3, and heating wire 2 is fixed to base material 1 in a desired wiring pattern by sewing.

Figure 2:
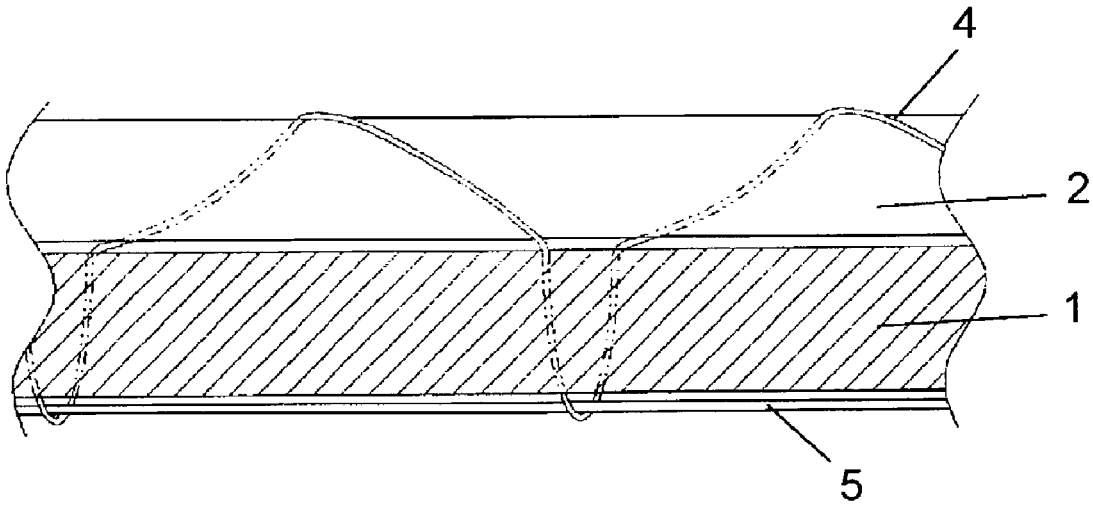
FIG. 2 is a side view showing a heater-fixing portion in the sheet heater in accordance with the first exemplary embodiment of the present invention.

FIG. 2 is a side view showing an example of fixation of a heating wire by sewing. With reference to FIG. 2, heating wire 2 is fixed to base material 1 using upper thread 4 and lower thread 5.

The effect of this structure is described hereinafter. When heating wire 2 is fixed using adhesive, thermal stress caused by repeated electrical conduction may deteriorate the adhesive, thereby peeling the heating wire from the base material. Fixation of heating wire 2 to base material 1 using upper thread 4 and lower thread 5 can solve this problem.

Heating wire 2 is simply held between upper thread 4 and lower thread 5 and thus provided with a certain degree of freedom in the lateral direction of FIG. 2. When the load and the like imposed on the seat during sitting generate wrinkles in base material 1, for the conventional fixation method using adhesive, heating wire 2 follows the wrinkles and bends at an acute angle because wire 2 is rigidly fixed to base material 1. The repeated bending may cause breakage of heating wire 2. In contrast, as the fixation method by sewing of the first exemplary embodiment does not fix wire 2 rigidly, a certain degree of freedom provided with heating wire 2 can alleviate bending of the heating wire at an acute angle and prevent breakage thereof. Especially for base material 1 having many through-holes 3, wrinkles are likely to occur. Therefore, the present invention can remarkably improve the durability of the sheet heater against the weight applied thereto during sitting.

Further, the present invention can improve stretch ability as a sheet heater more than the conventional method of fixing a heating wire with adhesive. For the conventional method of fixing a heating wire with adhesive, a base material impregnated with the adhesive hardens, and the heating wire itself has a low degree of freedom. For these reasons, the conventional sheet heater cannot deform according to the bending of the seat caused during sitting; thus comfortable feeling of sitting in the seat may be impaired. Fixation of heating wire 2 by sewing as described in the first exemplary embodiment does not cause hardening of base material 1 and a high degree of freedom to heating wire 2 is obtained. As a result, the sheet heater can deform according to the bending of the seat caused during sitting; thus, the comfortable feeling of sitting in the seat is achieved.

For the first exemplary embodiment, upper thread 4 and lower thread 5 are used as means of fixing heating wire 2. However, the present invention is not limited to these means. By devising a sewing method, heating wire 2 can be used in place of lower thread 5. Specifically, lower thread 5 on the lower side of base material 1 in FIG. 2 is replaced with heating wire 2. The heating wire used as the lower thread is combined with upper thread 4 for sewing. This method allows sewing the heating wires onto the front and back faces of base material 1, thereby realizing a large amount of heat generation.

Further, heating wire 2 on the upper side of base material 1 shown in FIG. 2 can be omitted to leave the lower heating wire used as the lower thread only. This structure eliminates the mechanism of supplying heating wire 2 on the upper side and the alignment mechanism between the base material 1 and heating wire 2 on the upper side during sewing. Thus, the heating wire can be sewn onto necessary positions freely. This structure can simplify the production process.

Additionally, in this embodiment, through-holes 3 are formed in positions where no heating wire 2 is fixed by sewing. Thus, the through-holes can be provided by pressing or other methods after placement of heating wire 2.

Further, though not shown, a base material having through-holes whose diameter is shorter than the sewing pitch of the heating wire can be used for placement of the heater thereon. In this case, uniform air-passing capability can be ensured throughout the surface of the sheet heater. Additionally, because there is no sewing failure, the heater can be fixed securely. Therefore, processing efficiency can be improved.

Next, the sewing failure in the present invention is described. In this invention, as shown in FIG. 2, heating wire 2 is sewn onto base material 1 by combination of upper thread 4 passing through base material 1 with the help of a sewing needle, lower thread 5 hooked by upper thread 4 that have passed through base material 1, and heating wire 2 that has been supplied. At this time, the thickness and tension of heating wire 2 are different from those of upper thread 4 and lower thread 5. Therefore, when the tension of each component is not adjusted to have a proper balance, upper thread 4 and lower thread 5 cannot be combined with each other and stitches may be missed. This is one of the forms of the sewing failure. Even when upper thread 4 and lower thread 5 are combined with each other but heating wire 2 is not fixed by the sewing, the state is also called the sewing failure. The latter case further includes a state of sewing the outside of heating wire 2 without fixing it, and a state of continuing sewing a through-hole portion in base material 1. The sewing pitch is a distance between the intersections of the upper and lower threads.

Second Embodiment

Figure 3:
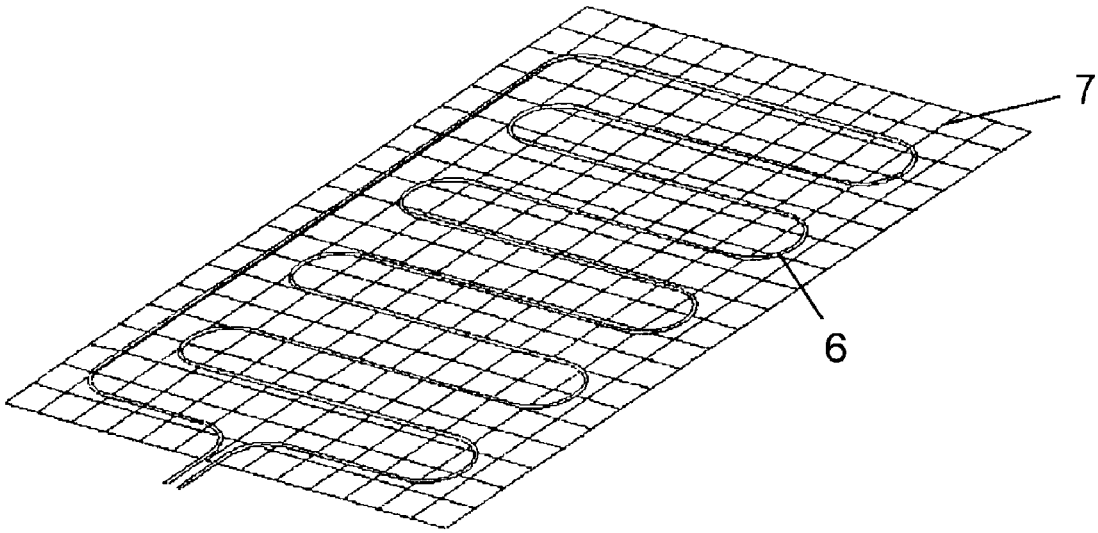
FIG. 3 is a perspective view of a sheet heater in accordance with a second exemplary embodiment of the present invention.

FIG. 3 is a schematic diagram of a sheet heater in which heating wire 6 is fixed to base material 7 of a mesh structure by sewing. With reference to FIG. 3, base material 7 has a mesh structure, and heating wire 6 is fixed to base material 7 in an arbitrary wiring pattern by sewing.

The use of base material 7 of a mesh structure can easily impart more excellent air-passing capability than a base material having through-holes made of a material, such as non-woven fabric.

When heating wire 6 is fixed to base material 7 of a mesh structure, the area in which heating wire 6 is in contact with base material 7 is smaller. For this reason, when heating wire 6 is fixed to base material 7 using adhesive, sufficient fixation cannot be provided against the weight applied to the seat during sitting and thus heating wire 6 may peel from base material 7. In contrast, sewing heating wire 6 onto base material 7 as shown in the second exemplary embodiment can provide sufficient fixation of heating wire 6 to base material 7 against the applied weight. This method can eliminate a protective material, thereby reducing the number of parts and simplifying the operations in production. Thus, an inexpensive sheet heater can be provided.

Figure 4:
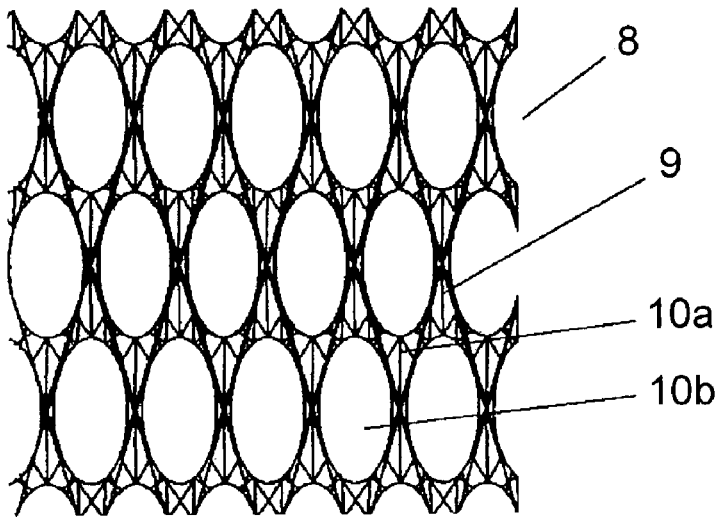
FIG. 4 is a plan view showing a detailed structure of another base material of the sheet heater in accordance with the second exemplary embodiment of the present invention.

FIG. 4 shows an example of forming a base material of a mesh structure by braiding threads. Base material 8 is made up of small openings 10*a* of densely braided threads 9 and large openings 10*b* formed among small openings 10*a*. Combining small openings 10*a* and large openings 10*b* to form base material 8 as shown in FIG. 4 can improve the mechanical strength of base material 8 and provide sufficient air-passing capability. In general, when each intersection in a mesh is formed of only two threads, stress placed on the base material is concentrated on the intersections in the mesh. This phenomenon poses a problem that the mesh breaks from the intersections. Constituting a base material to have mesh-like small openings 10*a* made of a plurality of threads adjacent to large openings 10*a* allows distribution of stress that is placed on the intersections in the base material by the weight applied to the seat during sitting. Thus, the strength of base material 8 can be improved.

Figure 5A:
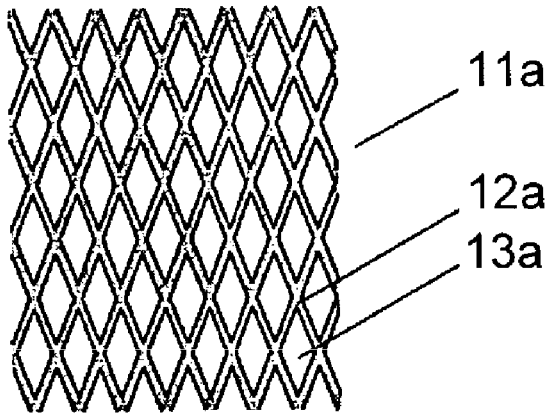
FIG. 5A is a plan view of another base material of the sheet heater in accordance with the second exemplary embodiment of the present invention.
Figure 5B:
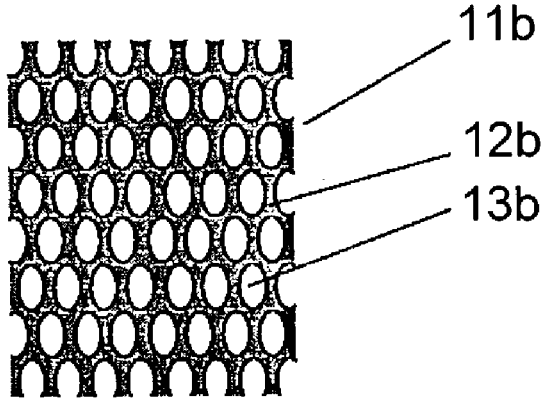
FIG. 5B is a plan view of still another base material of the sheet heater in accordance with the second exemplary embodiment of the present invention.
Figure 5C:
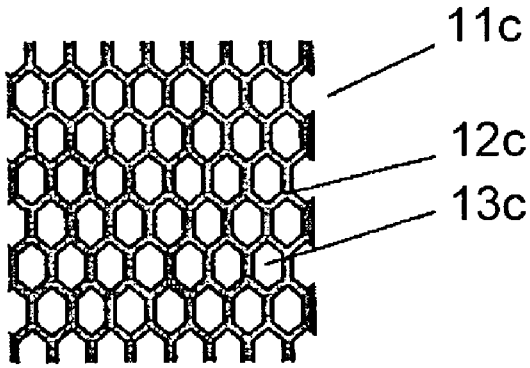
FIG. 5C is a plan view of yet another base material of the sheet heater in accordance with the second exemplary embodiment of the present invention.

Examples of the shapes of the openings in the mesh are shown in FIGS. 5A, 5B, and 5C. FIGS. 5A, 5B, and 5C show base materials that have substantially rhombic, elliptical, and hexagonal openings, respectively, in the mesh. Base material 11*a* is made up of small openings 12*a* and substantially rhombic large openings 13*a*. Base material 11*b* is made up of small openings 12*b* and substantially elliptical large openings 13*b*. Base material 11*c* is made up of small openings 12*c* and substantially hexagonal large openings 13*c*. With these structures, adjacent large openings can be placed densely. This arrangement can ensure the largest total area of the openings and the mechanical strength.

As the material constituting the mesh structures of base materials 11*a*, 11*b*, and 11*c*, threads made of polyester or the like are used. The material or structure of the region constituting the mesh structure is not limited to those described above. The shape of the opening is not limited to those shown in FIGS. 5A, 5B, and 5C.

The use of base materials 11*a*, 11*b*, and 1*c* each having mesh-like openings can easily alleviate changes in the shape of the sheet heater after sewing. Next, a description is provided of a case using base material 11*a*.

Generally, in equipment for fixing heating wire 6, such as a sewing machine, base material 11*a* is moved instead a needle of the sewing machine. When base material 11*a* is moved, it is necessary to hold the top side of base material 11*a* in the direction in which base material 11*a* is fed, or the side of base material 11*a* perpendicular to the top side, using a holding fixture, and move the fixture. However, when base material 11*a* is moved while being held using the holding fixture, a certain tension is placed on base material 11*a*. In the case of highly stretchable base material 11*a* like a mesh, there is a problem: because holding using the fixture increases elongation of base material 11*a*, the elongation restored after heating wire 6 is sewn onto the base material cause distortion of the fixed shape of heating wire 6 and the outer shape of the sheet heater.

Figure 6:
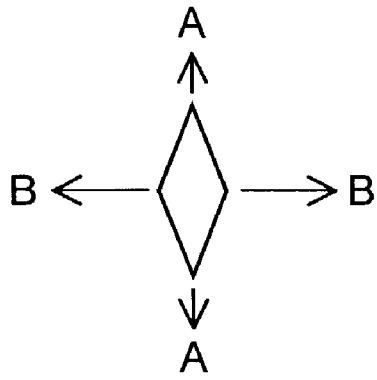
FIG. 6 is an enlarged view showing a large opening of the sheet heater in accordance with the second exemplary embodiment of the present invention.

This problem can be solved by appropriately selecting the shape or direction of the openings in the mesh according to the tension generated when base material 11*a* is held. FIG. 6 is a partially enlarged view of a base material of a mesh structure having substantially rhombic large openings. For such a mesh having substantially rhombic large openings, even when the same tension is placed on the base material, the amount of change in the direction of longer diagonal line A is smaller than that in the direction of shorter diagonal line B. In this case, attaching a holding fixture along line A in production can inhibit deformation after processing. Similarly, for a mesh having substantially elliptical or hexagonal large openings, the longitudinal direction of large openings in base material 11*b* or 11*c* is held. This can decrease the elongation in the direction in which the base material is held and thus restoration of the elongation. As a result, accuracy of the outer shape, position in which heating wire 6 is fixed, or the like can be improved. In the second exemplary embodiment, substantially rhombic, elliptical, and hexagonal shapes are described as the shapes of large openings. However, the shape is not limited to these.

Third Embodiment

Figure 7:
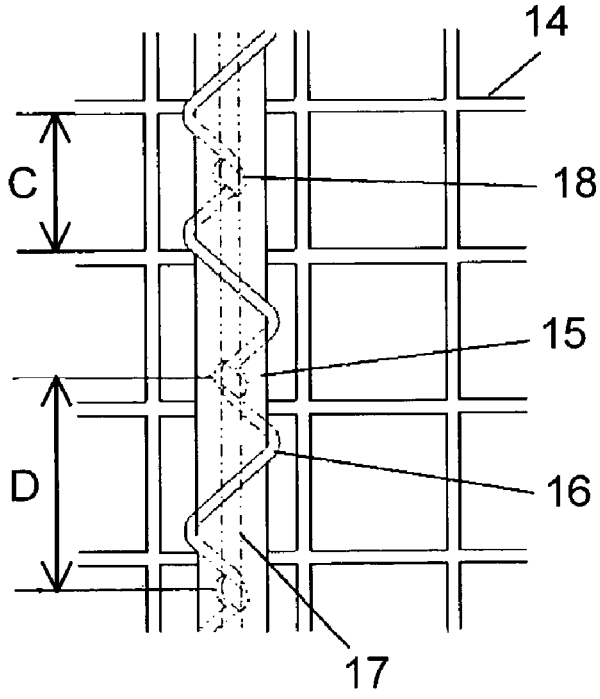
FIG. 7 is a plan view of a sheet heater in accordance with a third exemplary embodiment of the present invention.
Figure 8:
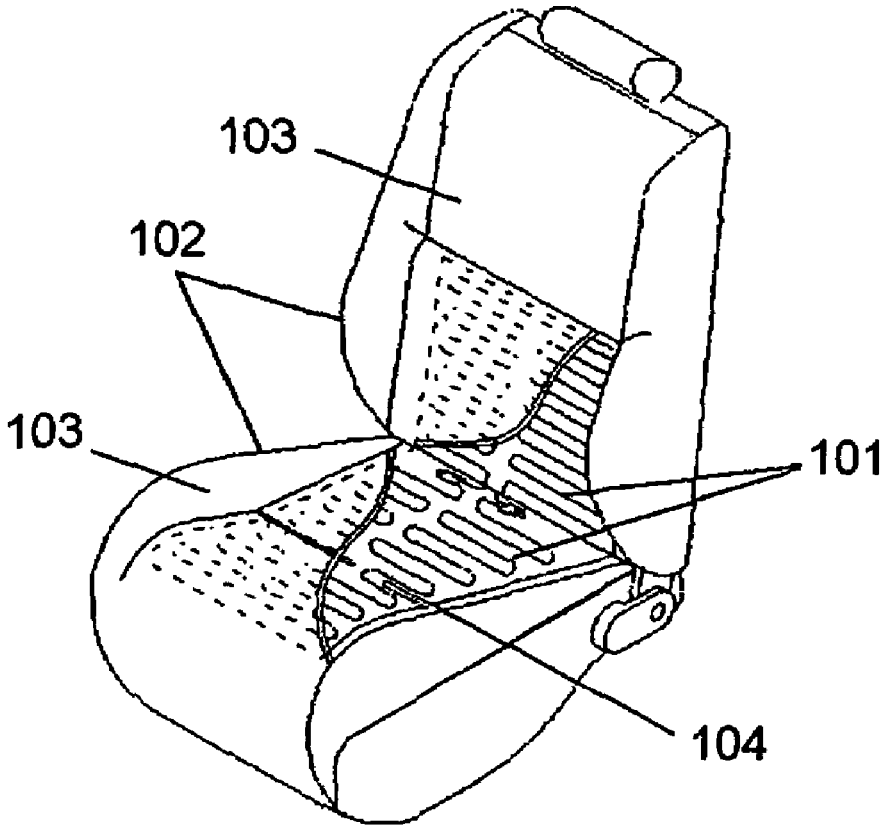
FIG. 8 (PRIOR ART)
FIG. 8 is a perspective view how a conventional sheet heater is incorporated in a seat for a vehicle.
Figure 9:
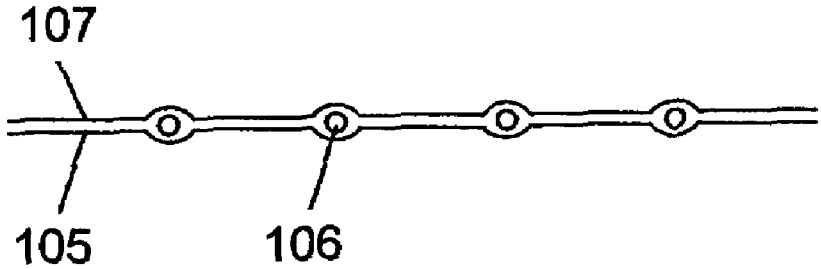
FIG. 9 (PRIOR ART)
FIG. 9 is a sectional side elevation view of the conventional sheet heater.

FIG. 7 is a schematic diagram showing the relation between a sewing pitch and a pitch of openings in a mesh.

With reference to FIG. 7, heating wire 15 is fixed to mesh-like base material 14 in a predetermined pattern using upper thread 16 and lower thread 17. A sewing point 18 is a point where upper thread 16 and lower thread 17 intersect each other to fix the heating wire onto base material 14. Now, setting the relation between pitch C of the openings in the mesh and pitch D at which heating wire 15 is sewn to C<D allows improvement in processing efficiency. If the relation is set to C>D, two sewing points 18 may appear in one opening. In other words, sewing point 18 that does not serve to fix the heating wire to base material 14 appears. Thus, processing efficiency decreases. Setting the relation to C<D can eliminate unnecessary sewing point 18, thus improving processing efficiency. As a result, an inexpensive sheet heater can be provided.

As described above, for a sheet heater of the present invention, sewing a heating wire onto an air-passing base material allows sufficient fixation of the heating wire against the load, such as weight, imposed on the seat during sitting. Additionally, the heating wire has a certain freedom higher than that provided by fixation using adhesive. Thus, even when wrinkles are generated in the base material by the weight applied to the seat during sitting, the heating wire is unlikely to follow the shape of the wrinkles. Therefore, breakage of the heating wire can be inhibited against the weight repeatedly applied to the seat during sitting.

What is claimed is:

1. A sheet heater comprising:

a base material having a mesh structure, said mesh structure is made up of small openings of densely braided threads and large openings formed among the small openings, said small openings being made of a plurality of the threads adjacent to said large openings, wherein the small openings are arranged in at least a central portion of the mesh structure; and a heating wire, said heating wire being fixed to said threads by sewing, wherein a diameter of each of the large openings is shorter than a sewing pitch for fixation of said heating wire.

2. The sheet heater of claim 1, wherein said base material further has an upper thread and a lower thread on front and back sides thereof, respectively, and said heating wire is fixed to said base material by the upper thread and the lower thread.

3. The sheet heater of claim 1, wherein the large openings of the mesh structure have one of substantially rhombic, elliptical, and hexagonal shapes.

4. A sheet heater comprising:

a base material having a mesh structure, said mesh structure has a smaller amount of change in a direction in which the base material is held than an amount of change in a direction perpendicular to the direction in which the base material is held when a tension is placed on the base material for holding the base material; and a heating wire, said heating wire being fixed to said base material by sewing, wherein said mesh structure is made up of small openings of densely braided threads and large openings formed among the small openings, said small openings being made of a plurality of the threads adiacent to said large openings, said small openings surround each of the large openings, and a diameter of each of the large openings is shorter than a sewing pitch for fixation of said heating wire.

5. The sheet heater of claim 4, wherein said base material further has an upper thread and a lower thread on front and back sides thereof, respectively, and said heating wire is fixed to said base material by the upper thread and the lower thread.

6. The sheet heater of claim 4, wherein the large openings of the mesh structure have one of substantially rhombic, elliptical, and hexagonal shapes.

* * * * *